United States Patent [19]

Sendlinger

[11] 3,977,170

[45] Aug. 31, 1976

[54] STRANDING MACHINE FOR MAKING ELECTRIC CABLES

[75] Inventor: Guenther Sendlinger, Roth, Germany

[73] Assignees: Leonische Drahtwerke AG, Nurnberg; Kunststoff- und Kabelmaschinenbau GmbH & Co. K.G., Gruiten, both of Germany

[22] Filed: Oct. 3, 1975

[21] Appl. No.: 619,315

[30] Foreign Application Priority Data

Oct. 5, 1974 Germany ..... 2447659

[52] U.S. Cl. ..... 57/13; 57/3

[51] Int. Cl.[2] ..... D07B 3/08; D07B 3/00

[58] Field of Search ..... 57/3, 6, 9, 13, 14, 57/15, 58.49, 59, 66, 67

[56] References Cited

UNITED STATES PATENTS

| | | | |
|---|---|---|---|
| 2,475,427 | 7/1949 | Henning | 57/13 |
| 2,479,928 | 8/1949 | Hanson et al. | 57/13 |
| 3,388,541 | 6/1968 | Biagini | 57/15 X |
| 3,604,192 | 9/1971 | Garner | 57/13 X |

FOREIGN PATENTS OR APPLICATIONS

| | | | |
|---|---|---|---|
| 777,667 | 6/1957 | United Kingdom | 57/14 |

*Primary Examiner*—Donald E. Watkins
*Attorney, Agent, or Firm*—Spencer & Kaye

[57] ABSTRACT

A stranding machine for making cables including a core wire supply reel having an axis coextensive with the operating direction; a plurality of strand element supply reels, each having a working position; a take-up reel for receiving the stranded cable containing the core wire taken from the core wire supply reel and the strand elements taken from the strand element supply reels; a rotatably supported stranding yoke having a rotary axis aligned with the axis of said take-up reel; and a plurality of rotatably supported fliers, one associated with the working position of each strand element supply reel. The stranding machine further has at least one electric motor for rotating the stranding yoke with a predetermined, constant rpm, for rotating the take-up reel with a variable rpm, that is a function of the coil diameter of the cable being wound on the take-up reel, the rpm of the stranding yoke and the twist length of the stranded cable, and further, for rotating each strand element supply reel in the working position with an rpm which causes each flier to rotate with an rpm that is identical to the rpm of the stranding yoke.

35 Claims, 7 Drawing Figures

STRANDING MACHINE FOR MAKING ELECTRIC CABLES

BACKGROUND OF THE INVENTION

This invention relates to a stranding machine, particularly for the manufacture of electric cables and conductors. The machine is of the type which has a core wire supply reel on which previously stranded core wire is wound and the axis of which is parallel to the feed (operating) direction of the stranding machine. The latter further has stationarily supported supply reels for receiving the strand elements as well as a take-up reel for the finished stranded product. The axis of the take-up reel is also oriented in the operating direction of the machine.

A cable making machine of the above-outlined type is disclosed, for example, in the periodical SIEMENS ZEITSCHRIFT, 1965, issue No. 1, pages 27–37. According to this publication, the take-up reel is stationarily supported. Such a stationary support of the take-up reel has the disadvantage that the stranding machine may operate only with a single twist length which necessarily changes as a function of the varying coil diameter. Further, the stranding machine of this type can perform no reverse twist which, however, is indispensable for certain applications of the electric cable.

SUMMARY OF THE INVENTION

It is an object of the invention to provide an improved stranding machine of the above-outlined type which is capable of performing a reverse twist, in which the twist length can be arbitrarily set within a wide range and maintained constant during the entire winding operation and with which substantially higher stranding rpm's are possible.

These objects and others to become apparent as the specification progresses, are accomplished by the invention, according to which, briefly stated, the stranding machine for making cables includes a core wire supply reel having an axis coextensive with the operating direction; a plurality of strand element supply reels, each having a working position; and a take-up reel for receiving the stranded cable containing the core wire taken from the core wire supply reel and the strand elements taken from the strand element supply reels; a rotatably supported stranding yoke having a rotary axis aligned with the axis of said take-up reel; and a plurality of rotatably supported fliers one associated with the working position of each strand element supply reel. The stranding machine further has at least one electric motor for rotating the stranding yoke with a predetermined, constant rpm, for rotating the take-up reel with a variable rpm that is a function of the coil diameter of the cable being wound on the take-up reel, the rpm of the stranding yoke and the twist length of the stranded cable, and further, for rotating each strand element supply reel in the working position with an rpm which causes each flier to rotate with an rpm that is identical to the rpm of the stranding yoke.

In a stranding machine designed according to the invention as outlined above, the twist length can be set arbitrarily between wide limits. Further, during the entire winding of the stranded product on the take-up reel the set twist length remains constant. By virtue of the fact that the supply reels can be driven by an electromotor in such a manner that the rpm of each flier is synchronous with the rpm of the stranding yoke, an advantageous 100% reverse twist is achieved. Further, due to the lightweight structure of the stranding machine according to the invention, the machine can operate with high stranding rpm's.

Similar to known stranding machines, in the stranding machine according to the invention a drawing device is disposed in front (upstream) of the take-up reel. For maintaining the preselected drawing tension in the cable, in the zone between the drawing device and the take-up reel there is disposed a computer into which data pertaining to the rpm of the stranding yoke, the take-up reel as well as the momentary twist length are fed. In this manner, there is obtained a proper coiling of the stranded product on the take-up reel; consequently, the product is not exposed to unnecessary stresses.

In order to ensure a clearance-free winding of the product from layer to layer, on the twisting yoke there is disposed an axially diplaceable coiling guide unit which is driven by an electromotor. The latter, in case of an rpm difference of "one" between the take-up reel and the stranding yoke, causes execution of the preselected coiling step.

In order to achieve a weight balancing and a guidance of the stranded product in case of a different stranding direction, there is provided an additional coiling guide unit which is positioned on the stranding yoke diametrically opposite the first coiling guide unit and which is displaceable synchronously therewith in the axial direction.

According to a further feature of the invention, the electromotor for the coiling guide unit is disposed stationarily externally of the stranding yoke. In this manner, the rotary masses are reduced and a more simple and more economical manufacture is possible.

The electromotor for the coiling guide unit has a reversing gear which is switched as a function of presettable rpm values of the electromotor. Further, roller-type guides are provided between the coiling guide units and the drawing device. In this manner, a space and weight saving arrangement is obtained which results in a substantial rpm increase.

According to another feature of the invention, the take-up reel is axially displaceably arranged for winding the stranded article in layers on the take-up reel, while the coiling guide unit is supported in an axially non-displaceable manner.

According to a further feature of the invention, the core wire supply reel is associated with a feed flier which is driven by an electromotor with an rpm that is synchronous with that of the stranding yoke. Further, the core wire supply reel can be driven by the same of a second electromotor in such a manner that a constant predetermined drawing tension of the prestranded product is ensured during the entire core wire supply operation. The core wire supply reel or the feed flier, or only a corresponding part of the feed flier, is displaceable in both axial directions.

In order to ensure a proper guidance of the stranded product in the different stranding directions, the feed flier has oppositely disposed roller guides. These roller guides have the additional advantage that they save space and weight and further make possible a substantial increase of the operational rpm. The roller guides have sensor devices to control the axial displacements of the core wire supply reel or the feed flier or a corresponding part of the feed flier. In this manner, a proper feed of the prestranded product from the core wire supply reel is ensured in a direction parallel to the reel flange.

Each supply reel has a flier which is rotatably supported in a frame and the brake of which can be set externally during operation. For each supply reel situated in its work position, there is provided an additional supply reel aligned therewith; both such supply reels are rotatably supported in a stand in a symmetrical relationship with respect to one another. The two supply reels are provided with a single flier. Each flier has two symmetrically arranged arms for guiding the strand element in the different stranding directions. Such an arrangement ensures a weight balancing and makes possible a high operational rpm.

By virtue of the structure of the stranding machine designed according to the invention, in the same stand supply reels of different dimensions may be inserted. It is further possible to provide obliquely oriented rollers for guiding the strand elements between the flier and the drawing device. These oblique rollers make possible a deflection of the rotating strand elements without a loss of reverse twist.

According to a further feature of the invention, the reverse twist can be set from 0 to 100% by altering the rpm of the flier relative to the rpm of the stranding yoke.

The rpm of the flier is adjustable and can be set to a value greater than that of the stranding yoke to give the stranded product the necessary inclination for closing-up.

For reducing the additional stresses on the strand elements during the acceleration or deceleration (braking) of the stranding machine, the usual stationary component of the flier brake is drivable by the electromotor serving the supply reels.

For dividing the stranding machine into two substantially identical stranding machines in a simple manner, the core wire feeding apparatus which supports the core wire supply reel is associated with a drawing device and further, several stands are turned 180° with their supply reels and fliers as well as their oblique rollers.

According to another feature of the invention, the shafts of the two symmetrically arranged supply reels and the stands as well as the fliers, have aligned bores for guiding an additional strand element which can be stranded with the strand element taken from the feed flier. In this manner, the conventionally two operational steps can be performed in a single operation. In this operation the flier may have an rpm which is other (preferably higher) than that of the stranding yoke and may rotate in the same or opposite direction relative to the stranding yoke. For this purpose, the flier may be driven by an electromotor.

DESCRIPTION OF THE PREFERRED EMBODIMENT

Figure 1:
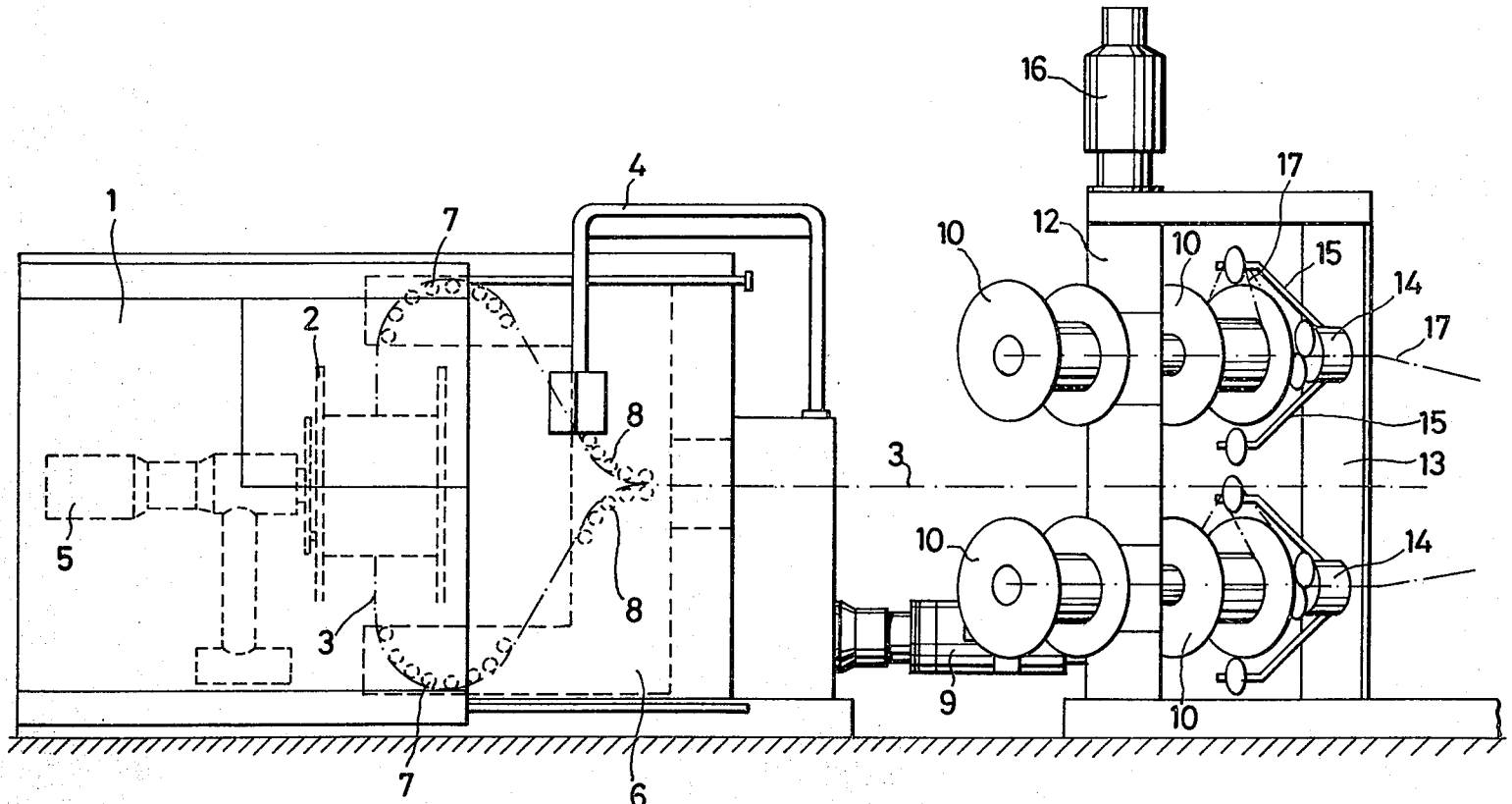
FIG. 1 is a schematic side elevational view of a core wire feeding device and several supply reels of a stranding machine according to the invention.
Figure 2:
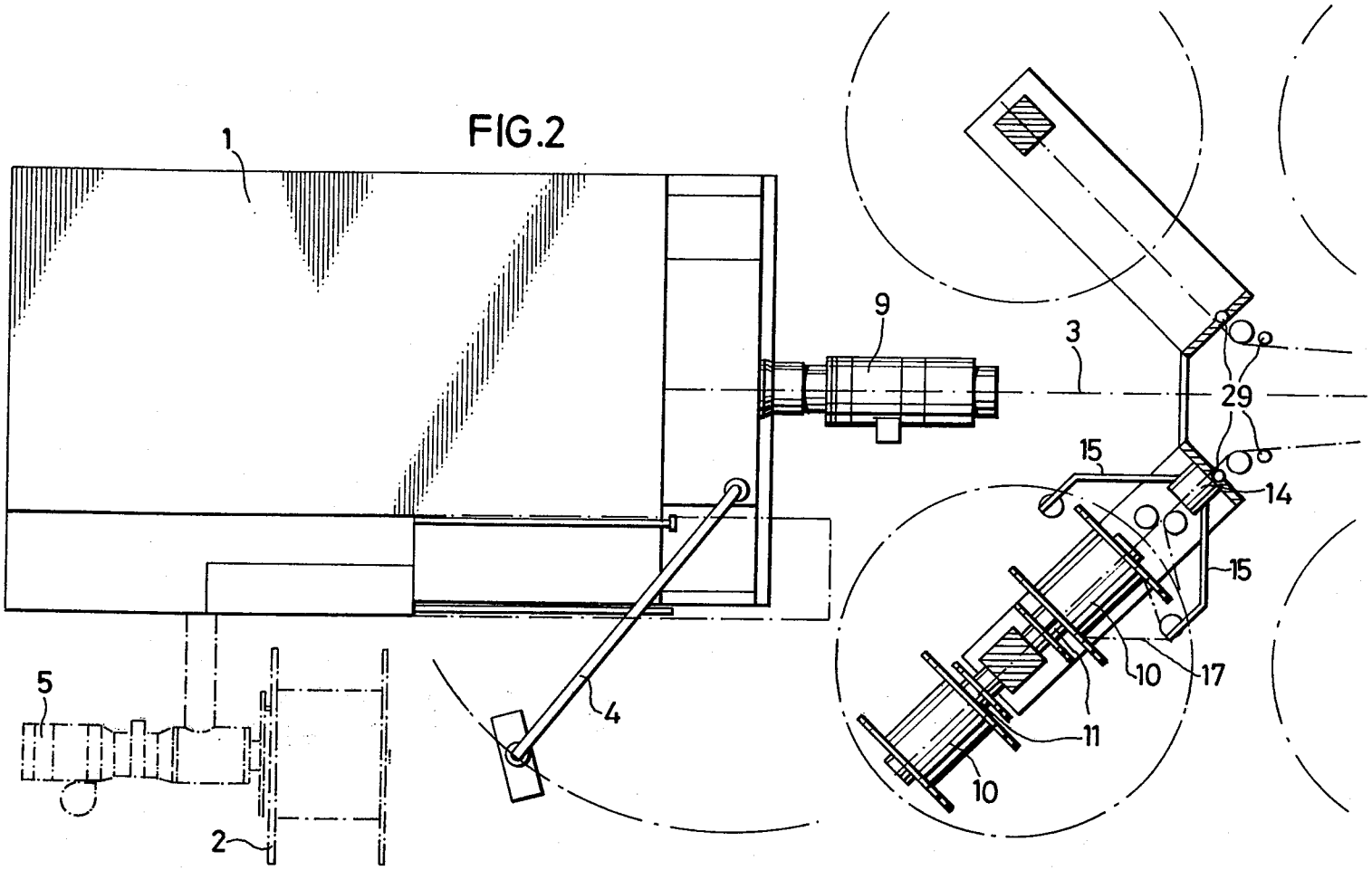
FIG. 2 is a schematic top plan view of the structure illustrated in FIG. 1.

Turning first to FIGS. 1 and 2, the stranding machine shown therein comprises a core wire feeding device 1 which rotatably supports a core wire supply reel 2 carrying a prestranded intermediate cable product 3 wound thereon. The cable 3 may be, for example, a multi-layer prestranded cable. The core wire supply reel 2 is supported in such a manner that it can easily be removed from its support and, with the aid of a pivotal handling mechanism 4, can be displaced from the device 1 into a position shown in phantom lines in FIG. 2. In this manner, an empty reel 2 can be replaced with ease with another, full reel 2. A d.c. motor 5 is provided for driving the core wire supply reel 2. Further, a U-shaped feed flier 6 is rotatably supported in the core wire feeding device 1 and is provided with roller guides 7 and 8 for guiding the cable 3. In order to insure a proper withdrawal of the cable 3 from the reel 2, either the reel 2 or the flier 6 or a corresponding part of the flier 6 is displaceably arranged in both axial directions. That part of the roller guides 7 which is oriented towards the core wire supply reel 2 may be provided with sensor devices for controlling the axial displacements of the reel 2 or the flier 6 or a component of the latter. In this manner, there is obtained a proper withdrawal of the cable 3 from the supply reel 2 in a direction parallel to the flanges of the reel 2. A d.c. motor 9 is provided for driving the feed flier 6.

Further, the stranding machine has a predetermined number of supply reels 10, each having a shaft 11 rotatably supported in stands 12. The supply reels 10 are grouped pair-wise; the shafts 11 of each reel forming one pair are aligned with one another. Each reel pair can be pivoted 180° in their stand 12. The inwardly positioned supply reel of one pair constitutes the work reel, while the outer reel of the same pair is the stand-by or reserve reel. When material from the work reel is exhausted, the reel pair is pivoted 180°, so that the outer full reserve reel assumes the working position, while the empty reel which is now situated at the outside, can be replaced with a new full reel. With each stand 12, there is fixedly connected a frame 13 in which fliers 14 are rotatably supported. Each flier 14 has two symmetrically arranged arms 15. As it may be well seen, particularly in FIG. 1, the stand 12 supports several supply reel pairs. The pivotal motion of each supply reel pair is effected by pivoting the corresponding stand 12 about its longitudinal axis. The supply reels 10 supported in one stand 12 are driven by a d.c. motor 16, while the fliers 14 are driven by the strand elements 17 and are braked mechanically or electromechanically for generating a drawing tension in the strand elements 17. The usual stationary component of the flier brake can be driven by the d.c. motor 16 provided for the supply reels 10.

While the inner supply reel 10 of a supply reel pair is in the work position, the outer, reserve supply reel 10 is stationary, since its shaft 11 has been disconnected from the drive by virtue of the 180° pivotal motion of the reel pair. In this manner, it is possible to replace the empty reel 10 with a full reel 10 during operation.

Figure 3:
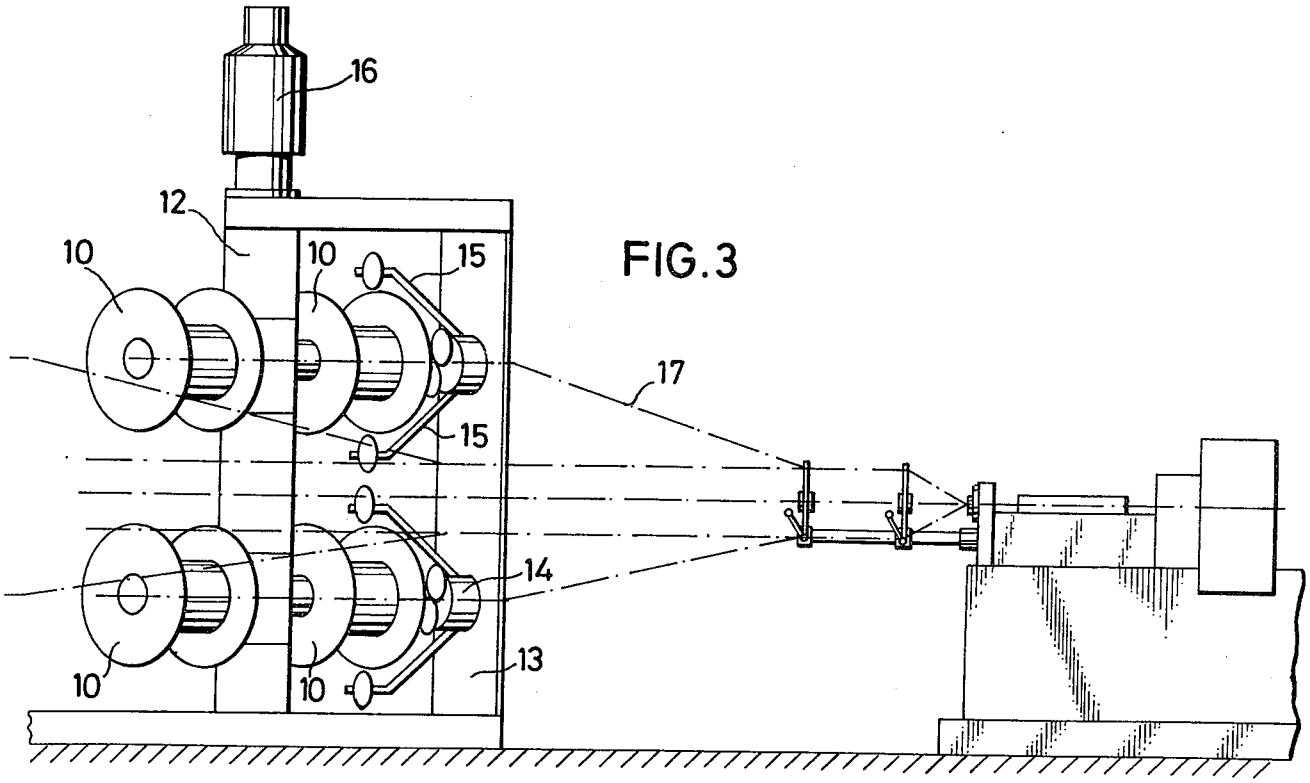
FIG. 3 is a schematic side elevational view of the last supply reels and an adjoining component of the stranding machine according to the invention.
Figure 4:
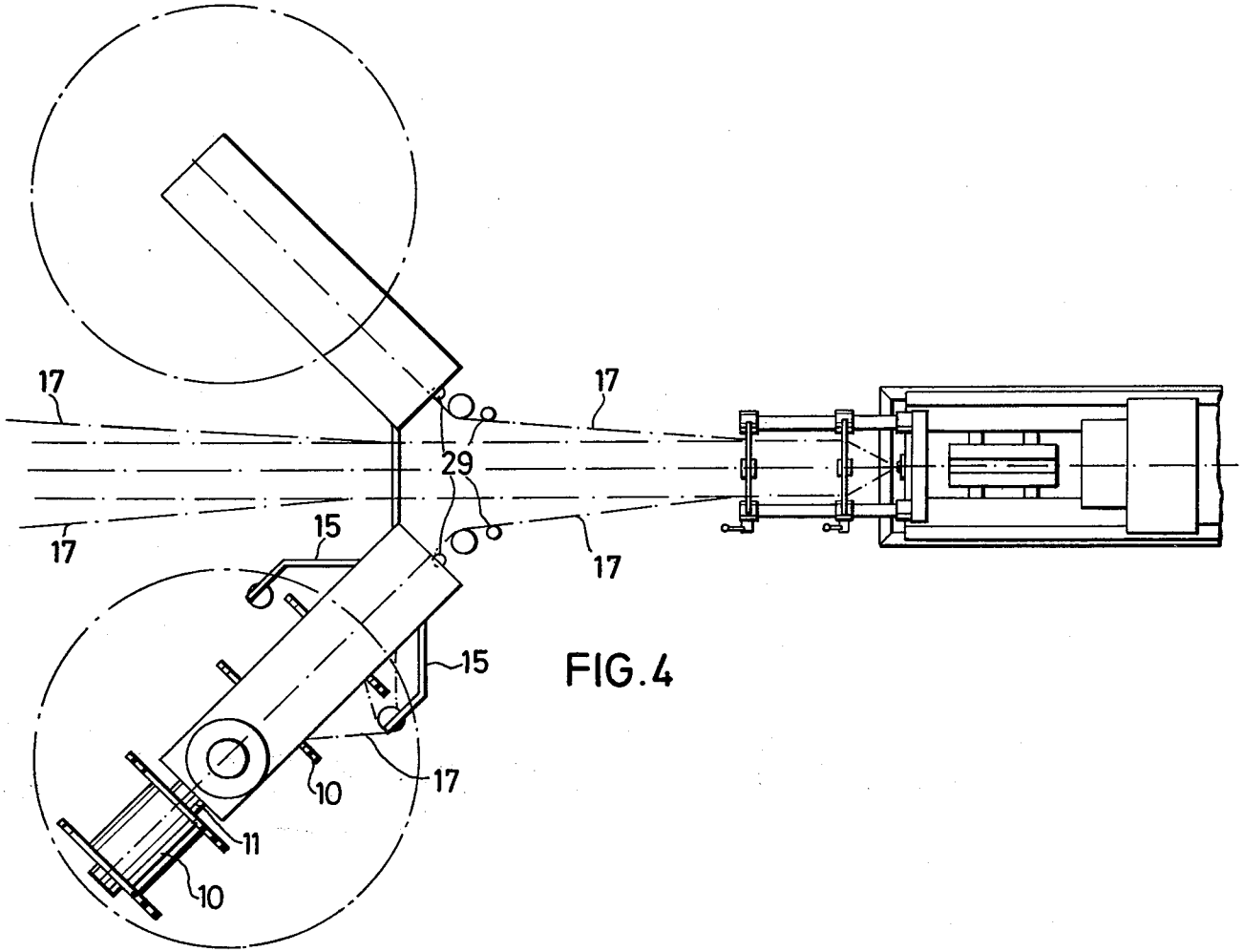
FIG. 4 is a schematic top plan view of the structure illustrated in FIG. 3.

In FIGS. 1 and 2, to the right of the assembly comprising the supply reels 10, the fliers 14, the stands 12 and the frames 13 and in FIGS. 3 and 4, to the left of the assembly comprising the same components there may be positioned additional identically constructed assemblies which are not shown for the sake of simplicity.

Figure 5:
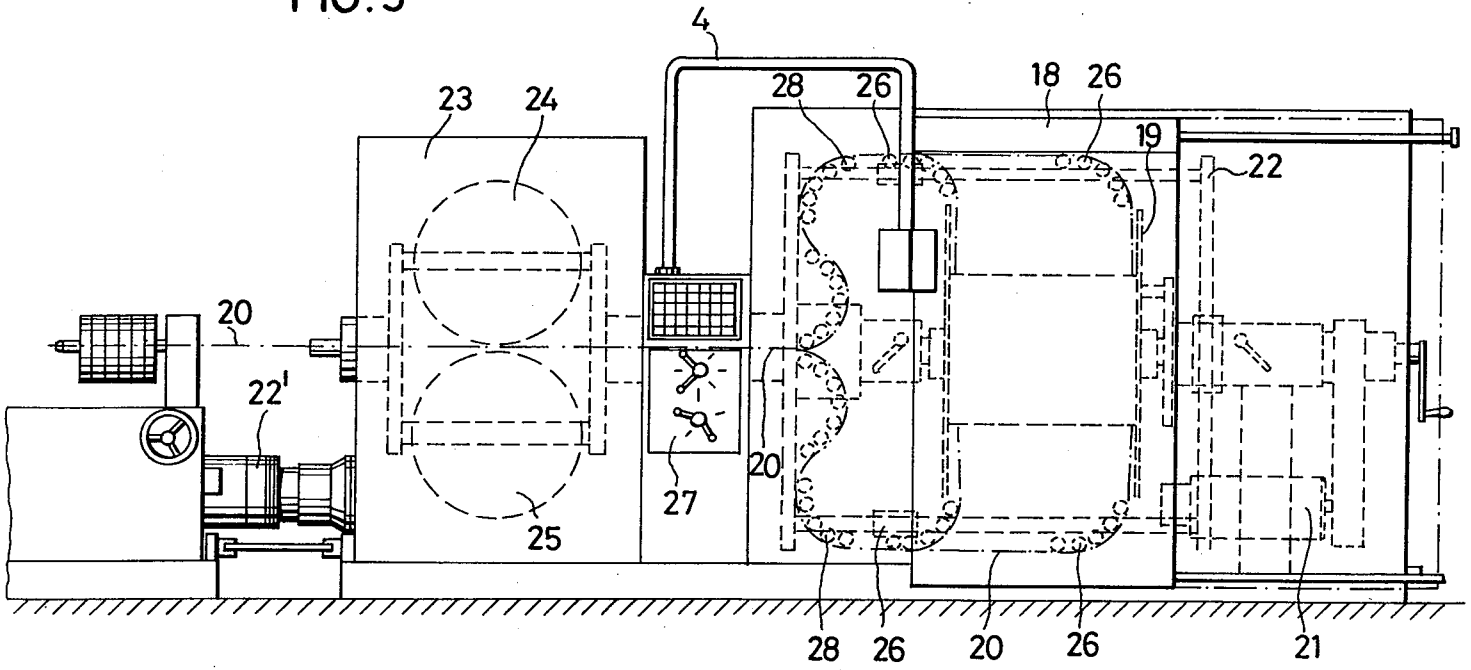
FIG. 5 is a schematic side elevational view of a drawing device and an adjoining winding device of the stranding machine according to the invention.
Figure 6:
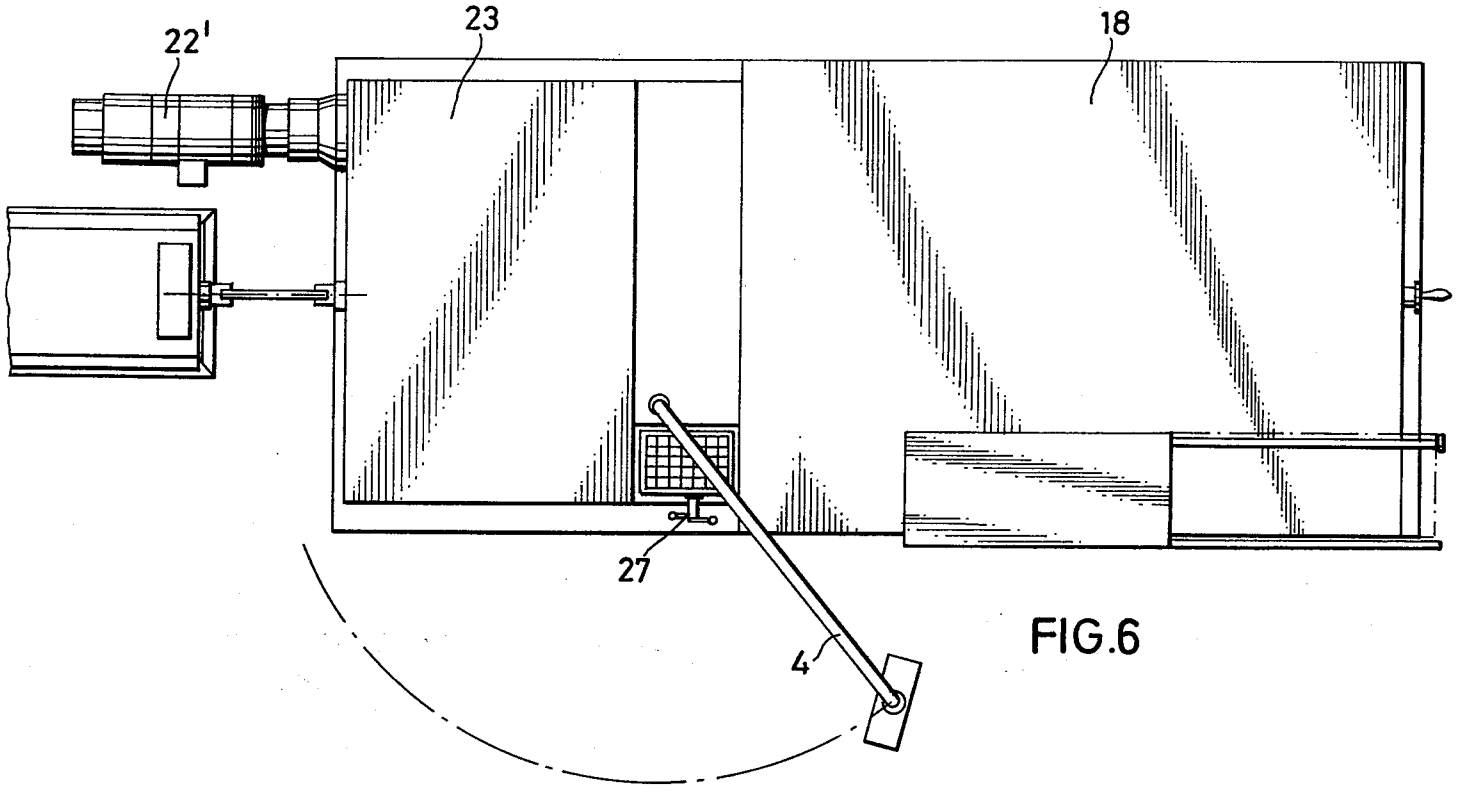
FIG. 6 is a schematic top plan view of the structure illustrated in FIG. 5.

Turning now to FIGS. 5 and 6, the stranding machine further comprises a winding apparatus 18 which includes a rotatably supported take-up reel 19 on which the finished product 20, such as an electric cable is wound. The winding apparatus 18 includes a d.c. motor 21 for driving the take-up reel 19. A stranding yoke 22 is rotatably supported in the winding device 18 and is disposed in axial alignment with the take-up reel 19. The stranding yoke 22 is driven with a predetermined adjustable constant rpm by a d.c. motor 22'. The d.c. motor 21 drives the take-up reel 19 with a variable rpm which is dependent upon the diameter of the cable coil on the take-up reel 19, the twist length and the rpm of the stranding yoke 22. Since the work speed of the stranding machine must remain constant, the d.c. motor 21 or the take-up reel 19 has to reduce its rpm as the diameter of the cable coil increases on the take-up reel 19. At the same time, a preselected drawing tension in the cable 20 has to be maintained between a drawing device 23 and the take-up reel 19. For this purpose, between the drawing device 23 and the take-up reel 19 there is provided a computer into which data relating to the rpm's of the stranding yoke 22, the take-up reel 19 and the momentary twist length are fed. The drawing device 23 has one or two drawing discs 24, 25 about which the cable 20 is wound with several turns and which draws the cable 20 in a slip-free manner. For this purpose, the drawing discs 24, 25 are driven as a function of the stranding yoke 22 with the interposition of a corresponding multi-stage change gear and differential gear. The drawing discs 24, 25 rotate with identical rpm's and in the same direction as the stranding yoke 22. Instead of a drawing device 23 having drawing discs 24, 25, a rotary band-type drawing device may be used.

For guiding the strand elements 17, oblique rollers 29 are provided between the fliers 14 and the drawing device 23. The rollers 29 ensure that the rotating strand elements 17 are deflected without losing their reverse twist.

Two coiling guide units 26 are axially displaceably arranged at diametrically opposed locations on the stranding yoke 22 for depositing the cable 20 in layers on the take-up reel 19. The coiling guide units 26 are driven by a separate, rpm-adjustable electromotor which, when there appears an rpm difference of "one" between the take-up 19 and the stranding yoke 22, effects the preselectable cable-depositing step. The electromotor associated with the coiling guide units 26 is stationarily supported externally of the stranding yoke 22. The electromotor provided for the coiling guide units 26 has a reversing gear which is switched dependent upon preselectable rpm's of the electromotor.

To the right of the drawing device 23, as viewed in FIGS. 5 and 6, there is provided a multi-stage change gear 27 for setting the twist length. As shown further is FIG. 5, the stranding yoke 22 has two diametrically opposite roller guides 28 situated between the coiling guide units 26 and the drawing device 23.

The take-up reel 19 can be removed from its support with ease by a proper handling device and brought out of the winding device 18 to make it possible to replace a full take-up reel 19 with an empty take-up reel 19. In case the take-up reel 19 carries a coil of a prestranded multi-layer cable made in the stranding machine, the take-up reel 19 can be inserted into the core wire supply device 1 instead of a core wire supply reel 2, so that in one or several successive operations a multi-layer cable can be made into a finished cable in the same machine.

The drawing device 23 may be omitted if the d.c. motor 21 for the take-up reel 19 is regulated in such a manner that a constant linear speed is obtained for the stranded product for the changing coil diameter on the take-up reel 19.

If a drawing device 23 is arranged in the zone of the core wire supply device 1 and the left part of the supply reels 10 works on the prestranded cable 3 of the reel 2 (which then can selectively be switched to assume the role of a take-up reel) there can be provided two essentially identical stranding machines in one complete stranding machine. Thus, the stranding machine according to the invention is very economical and versatile.

Figure 7:
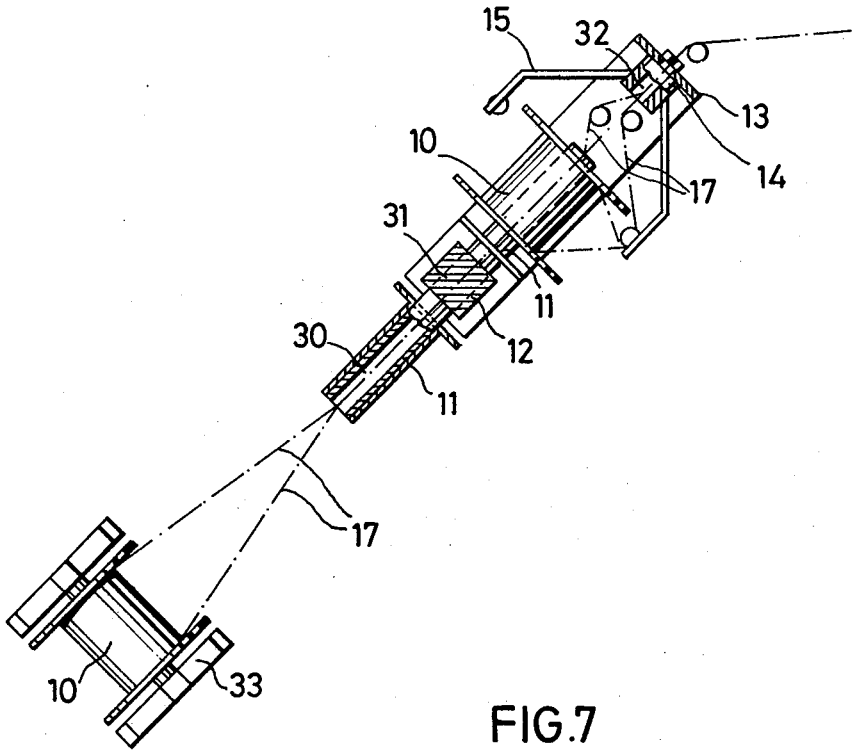
FIG. 7 is a schematic top plan view of two aligned supply reels with the associated fliers and an additional supply reel, shown partially in section.

Turning now to FIG. 7, the shafts 11 of the two symmetrically arranged supply reels 10 and strands 12 as well as the associated fliers 14 can be provided with aligned bores 30, 31, 32 which serve for guiding an additional strand element 17 to be stranded with the strand element 17 running off a flier 14. The additional strand element 17 is wound on a supply reel 10 which is rotatably held in a stationary manner, for example, in a stand 33 affixed to the floor.

It will be understood that the above description of the present invention is susceptible to various modifications, changes and adaptations, and the same are intended to be comprehended within the meaning and range of equivalents of the appended claims.

What is claimed is:

1. In a stranding machine for making cables, the machine having an operating direction and including a core wire supply reel having an axis coextensive with the operating direction; a plurality of strand element supply reels, each having a working position; and a take-up reel for receiving the stranded cable containing the core wire taken from the core wire supply reel and the strand elements taken from the strand element supply reels, the take-up reel having an axis coextensive with the operating direction, the improvement comprising a. a rotatably supported stranding yoke having a rotary axis aligned with the axis of said take-up reel;

b. a plurality of rotatably supported fliers, individually associated with the working position of each said strand element supply reel; and c. electric motor means for rotating said stranding yoke with a predetermined, constant rpm, for rotating said take-up reel with a variable rpm that is a function of the coil diameter of the cable being wound on said take-up reel, the rpm of said stranding yoke and the twist length of the stranded cable, and for rotating each strand element supply reel in the working position with an rpm causing each flier to rotate with an rpm that is identical to the rpm of said stranding yoke.

2. A stranding machine as defined in claim 1, wherein said electric motor means is constituted by a sole electric motor.

3. A stranding machine as defined in claim 1, wherein said electric motor means is constituted by a first electric motor driving said stranding yoke, a second electric motor driving said take-up reel, and a third electric motor driving said strand element supply reels.

4. A stranding machine as defined in claim 1, further comprising a computer for maintaining a preselected drawing tension of the stranded cable and means for feeding into the computer the twist length, the rpm of said stranding yoke and the rpm of said take-up reel.

5. A stranding machine as defined in claim 1, further comprising a coiling guide unit axially displaceably mounted on said stranding yoke for the coiling of the stranded cable on said take-up reel in layers; and an additional electric motor means driving said coiling guide unit for effecting a preselected coiling step when the difference between the rpm of said take-up reel and said stranding yoke is 1.

6. A stranding machine as defined in claim 5, further comprising an additional coiling guide unit axially displaceably mounted on said stranding yoke; the two coiling guide units being arranged diametrically opposite on said stranding yoke and being axially displaceable in synchronism.

7. A stranding machine as defined in claim 5, wherein said additional motor means being stationarily arranged externally of said stranding yoke.

8. A stranding machine as defined in claim 5, wherein said additional electric motor means includes a reversing gear and means for switching said reversing gear in response to presettable rpm's of said additional motor means.

9. A stranding machine as defined in claim 5, further including roller guide means mounted on said stranding yoke between said coiling guide unit and a drawing device disposed between said strand element supply rollers and said stranding yoke.

10. A stranding machine as defined in claim 1, further comprising an axially immobilized coiling guide unit and means for axially displacing said take-up reel for winding the stranded cable on said take-up reel in layers.

11. A stranding machine as defined in claim 1, further including a rotatably supported supply flier cooperating with said core wire supply reel, and an additional electric motor means constituting a sole electric motor for driving said supply flier with an rpm identical to the rpm of said stranding yoke and for driving said core wire supply reel with an rpm effecting a predetermined, constant drawing tension of the core wire during operation.

12. A stranding machine as defined in claim 1, further including a rotatably supported supply flier cooperating with said core wire supply reel, and an additional electric motor means comprising a first electric motor for driving said supply flier with an rpm identical to the rpm of said stranding yoke and a second electric motor for driving said core wire supply reel with an rpm effecting a predetermined, constant drawing tension of the core wire during operation.

13. A stranding machine as defined in claim 11, wherein said core wire supply reel is supported for axial displacement in both directions.

14. A stranding machine as defined in claim 11, wherein at least one part of said supply flier is supported for axial displacment in both directions.

15. A stranding machine as defined in claim 11, wherein said supply flier carries diametrically oppositely situated roller guides.

16. A stranding machine as defined in claim 13, wherein said supply flier carries diametrically oppositely situated roller guides including sensor means for controlling the axial displacements of said core wire supply reel.

17. A stranding machine as defined in claim 14, wherein said supply flier carries diametrically oppositely situated roller guides including sensor means for controlling the axial displacements of at least one part of said supply flier.

18. A stranding machine as defined in claim 1, further comprising a frame rotatably supporting each said flier; each flier having a brake; and means for externally setting each brake during operation.

19. A stranding machine as defined in claim 18, further comprising a stand rotatably supporting a pair of strand element supply reels in axial alignment with one another; one reel of the pair being in its working position and the other reel of the pair being in an inoperative position; and means for exchanging positions of the reels of said pair in their stand; with each pair there is associated one of said fliers.

20. A stranding machine as defined in claim 19, wherein each flier has two symmetrically arranged flier arms.

21. A stranding machine as defined in claim 19, wherein one and the same stand supports strand element supply reels of different dimensions.

22. A stranding machine as defined in claim 1, further comprising obliquely oriented rollers for guiding the strand elements; said obliquely oriented rollers being disposed between said fliers and a drawing device situated between said stranding yoke and said strand element supply reels.

23. A stranding machine as defined in claim 1, further comprising means for varying the rpm of the fliers relative to the rpm of the stranding yoke for varying a reverse twist between 0 and 100%.

24. A stranding machine as defined in claim 11, further comprising means for varying the rpm of said supply flier relative to the rpm of the stranding yoke for varying a reverse twist between 0 and 100%.

25. A stranding machine as defined in claim 12, further comprising means for varying the rpm of said supply flier relative to the rpm of the stranding yoke for varying a reverse twist between 0 and 100%.

26. A stranding machine as defined in claim 23, wherein said means for varying the rpm of the fliers includes means for setting the rpm of the fliers beyond the rpm of said stranding yoke.

27. A stranding machine as defined in claim 24, wherein said means for varying the rpm of said supply flier includes means for setting the rpm of said supply flier beyond the rpm of said stranding yoke.

28. A stranding machine as defined in claim 25, wherein said means for varying the rpm of said supply flier includes means for setting the rpm of said supply flier beyond the rpm of said stranding yoke.

29. A stranding machine as defined in claim 18, further comprising a stationary part of each brake and means for operatively connecting each said part with said electric motor means.

30. A stranding machine as defined in claim 29, wherein said electric motor means includes an electric motor operatively connected to said strand element supply reels and each said part of said brakes.

31. A stranding machine as defined in claim 19, wherein the strand element supply reels forming each pair have axially aligned shafts; further comprising means defining axially aligned throughgoing bores in said shafts, the associated stand and the associated flier for defining a continuous passage for an additional strand element adapted to be stranded with the strand elements drawn from said strand element supply reels.

32. A stranding machine as defined in claim 31, further comprising means for driving said fliers with an rpm different from the rpm of said stranding yoke and means for driving said fliers in the same direction as the direction of rotation of said stranding yoke.

33. A stranding machine as defined in claim 31, further comprising means for driving said fliers with an rpm different from the rpm of said stranding yoke and means for driving said fliers in a direction opposite to the direction of rotation of said stranding yoke.

34. A stranding machine as defined in claim 31, further including an additional electric motor means for driving said fliers.

35. A method of stranding a cable in a stranding machine which has, in succession in the operating direction of the machine, a core wire supply reel, strand element supply reels, fliers associated with the strand element supply reels, a drawing device for drawing, under tension, material from the core wire supply reel and the strand element supply reels, a stranding yoke and a take-up reel on which the stranded cable is wound, comprising the following steps:

a. rotating the stranding yoke with a predetermined, constant rpm with the stranding yoke axis in alignment with the axis of the take-up reel;

b. rotating said take-up reel with a variable rpm that is a function of the coil diameter of the cable on the take-up reel, the rpm of the stranding yoke and the twist length; and c. rotating the strand element supply reels with an rpm such that the rpm of each flier is identical to the rpm of the stranding yoke.

* * * * *